US006625988B2

(12) United States Patent
Weisenstein et al.

(10) Patent No.: US 6,625,988 B2
(45) Date of Patent: Sep. 30, 2003

(54) PREMIX BURNER ARRANGEMENT WITH CATALYTIC COMBUSTION AND METHOD FOR ITS OPERATION

(75) Inventors: Wolfgang Weisenstein, Remetschwil (CH); Timothy Albert Griffin, Ennetbaden (CH); Peter Jansohn, Kussaberg (DE); Thomas Ruck, Rekingen (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/991,969

(22) Filed: Nov. 26, 2001

(65) Prior Publication Data

US 2002/0106599 A1 Aug. 8, 2002

(30) Foreign Application Priority Data

Dec. 11, 2000 (DE) ..... 100 61 527

(51) Int. Cl.[7] ..... F02C 7/22

(52) U.S. Cl. ..... 60/777; 60/737; 60/39.463; 431/7; 431/181

(58) Field of Search ..... 60/39.463, 723, 60/737, 748, 777; 431/7, 181, 182, 185, 268, 350

(56) References Cited

U.S. PATENT DOCUMENTS

| | | | | |
|---|---|---|---|---|
| 4,040,252 A | * | 8/1977 | Mosier et al. | 60/39.36 |
| 5,623,819 A | * | 4/1997 | Bowker et al. | 60/39.06 |
| 5,626,017 A | * | 5/1997 | Sattlemayer | 60/723 |
| 5,634,784 A | | 6/1997 | Pfefferle et al. | |
| 5,826,422 A | * | 10/1998 | Koyama et al. | 60/39.12 |
| 5,950,434 A | | 9/1999 | Hums et al. | |
| 6,415,608 B1 | * | 7/2002 | Newburry | 60/723 |

FOREIGN PATENT DOCUMENTS

| | | | |
|---|---|---|---|
| DE | 28 09 407 A1 | | 9/1978 |
| DE | 44 26 351 A1 | | 2/1996 |
| DE | 195 21 356 C2 | | 12/1996 |
| EP | 0 491 481 A1 | | 6/1992 |
| EP | 0 611 433 B1 | | 8/1994 |
| EP | 0 833 105 A2 | | 4/1998 |
| JP | 402052931 A | * | 2/1990 |
| JP | 02259331 A | | 10/1990 |
| JP | 10339438 A | | 12/1998 |
| JP | 410339438 A | * | 12/1998 |

* cited by examiner

*Primary Examiner*—Charles G. Freay
*Assistant Examiner*—John F. Belena
(74) *Attorney, Agent, or Firm*—Burns, Doane, Swecker & Mathis, L.L.P.

(57) ABSTRACT

A premix burner arrangement with catalytic combustion provides a fuel/air mixture to a combustion chamber of a gas turbine arrangement. The premix burner arrangement includes a premix burner, at least one fuel addition unit, and air inlet openings arranged in such a way that at least one of gaseous and liquid fuel can be mixed with combustion inlet air inside the premix burner to form a fuel/air mixture. The fuel/air mixture exits from the premix burner downstream in the direction towards a combustion chamber positioned after the premix burner arrangement and can be ignited inside the combustion chamber. A catalyzer unit is provided before the entrance of the fuel/air mixture into the combustion chamber. Part of the fuel/air mixture can be introduced into and passed through the catalyzer unit before the catalyzed part of the fuel/air mixture flows together with the remaining portion of the fuel/air mixture into the combustion chamber.

13 Claims, 2 Drawing Sheets

PREMIX BURNER ARRANGEMENT WITH CATALYTIC COMBUSTION AND METHOD FOR ITS OPERATION

FIELD OF TECHNOLOGY

Figure 1:
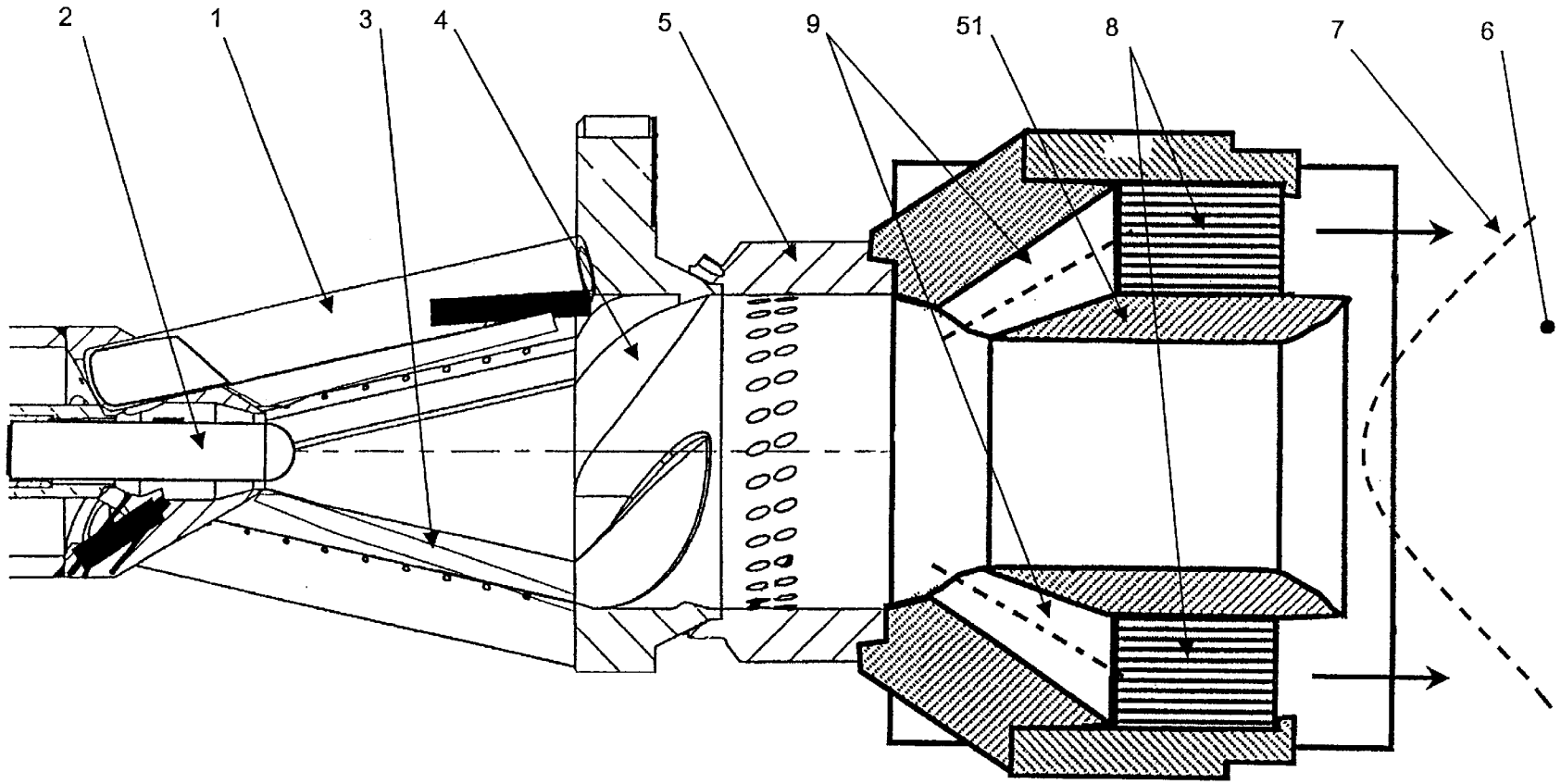

The invention relates to a premix burner arrangement with catalytic combustion for operating a combustion chamber of a gas turbine arrangement, as well as a method to this effect, having a premix burner, wherein at least one fuel addition unit as well as inlet air openings have been provided in such a way that gaseous and/or liquid fuel can be mixed with combustion inlet air inside the premix burner and form a fuel/air mixture, which exits from the premix burner downstream in the direction towards the combustion chamber positioned after the premix burner arrangement and which can be ignited inside the combustion chamber.

STATE OF THE ART

A premix burner arrangement of this type is disclosed in EP 0 833 105 A2. The premix burner described in this document is provided with a central fuel nozzle axially towards the swirl generator, said swirl generator being followed downstream by a mixing section in which the atomized fuel is mixed completely with air to form a fuel/air mixture. At the downstream outlet of the mixing pipe, the combustion chamber is provided, inside which a spatially stable flame zone forms when the premix burner is operated.

Even though the known premix burner arrangement has been designed with a view towards improved emission values, i.e., in particular reduced NOx emission values, by providing a mixing section, an objective is in particular to farther improve the waste gas values of combustion systems of this type. Furthermore, so-called combustion chamber vibrations occur during the operation of known premix burner arrangements, to the great disadvantage of flame stability. Such combustion chamber vibrations or pulsations have a particularly disadvantageous effect in operating states where lean fuel/air mixtures are used. This results in high lean extinction limits, i.e., an extinction of the flame in spite of relatively high fuel content, causing the operating range of the premix burner to be greatly limited, especially with respect to a lean operation.

Previous approaches and attempts to combine premix burner arrangements with catalyzers in order to reduce at least the previously mentioned NOx emissions in the combustion process failed or provided only unsatisfactory results, especially since the usual use of liquid fuel, for example oil, for firing such premix burner arrangements makes catalyzers known per se unusable because it obstructs the catalyzer openings.

DESCRIPTION OF THE INVENTION

The invention is based on the objective of further developing a premix burner arrangement with catalytic combustion for operating a combustion chamber of a gas turbine arrangement according to the preamble of claim 1 in such a way that on the one hand, measures are implemented through which the NOx emission values are supposed to be substantially reduced. And in addition, the measures should result in flame stabilization within the combustion chamber so that the operating ranges of the premix burner arrangement are expanded, in particular with respect to an improved lean extinction limit.

The realization of the objective of the invention is disclosed in claim 1. The subject of claim 9 is a method for operating a premix burner arrangement with catalytic combustion. Characteristics that advantageously further develop the concept of the invention are the subject of the secondary claims and specification in reference to the exemplary embodiments.

According to the invention, a premix burner arrangement according to the preamble of claim 1 is further developed in such a way that, prior to the entrance of the fuel/air mixture into the combustion chamber, a catalyzer unit is provided, through which part of the fuel/air mixture can be introduced and passes through, before this part flows, together with the remaining portion of the fuel/air mixture into the combustion chamber.

An essential aspect in using a catalyzer unit within an actually known premix burner, which is usually operated with liquid fuel such as, for example, oil, is the positioning of the catalyzer unit in an area downstream from the atomizing nozzle of the premix burner in which the fuel/air mixture is completely mixed and the liquid fuel is spatially distributed very finely or is already largely evaporated. If fuel in the previously mentioned form enters a catalyzer, it is possible to convert the fuel at least in part catalytically inside the catalyzer, for example by means of a thermal and/or chemical conversion, without destroying or obstructing the catalyzer material itself in the process.

According to the invention, only part of the fuel/air mixture spreading through the premix burner in the direction towards the combustion chamber passes through the catalyzer unit, especially since the catalyzer unit preferably is positioned concentrically at the outlet of the premix burner or the mixing section, just before the entrance into the combustion chamber, so that only peripheral partial flows of the fuel/air mixture spreading in the direction towards the combustion chamber flow through the catalyzer unit. After the at least in part catalytically converted fuel/air mixture exits from the catalyzer unit, the at least partially converted mass flow reaches edge areas of the flame front that forms inside the combustion chamber, so that the flame itself can be clearly stabilized. The effects of the flame stabilization due to the peripheral mass flows become especially obvious in operating states where lean mixtures are used. An especially important indication of the positive effect of the mass flows entering the combustion chamber peripherally can be seen in the decrease of the lean extinction limit, which makes it possible to significantly expand the operating ranges of the premix burner. Combustion chamber pulsations also occur much less.

Because of the peripheral arrangement of the catalyzer unit in relation to the fuel/air mixture that spreads axially inside the premix burner, an unlimited operation with liquid fuel such as, for example, oil, is possible, in spite of the presence of the catalyzer unit before the combustion chamber. Since the fuel injection takes place centrally in relation to the premix burner axis, but the catalyzer unit is positioned as far as possible from the fuel injection, and only at the outer periphery of the spreading fuel/air mixture, the catalyzer unit is able to withstand an oil combustion inside the burner system without damage.

In principle, it is possible to position the catalyzer unit distributed in a partial or completely circular manner around the mixing pipe, whereby a circularly extending outlet channel inside the mixing pipe is provided for the partial separation of peripheral partial flows of the fuel/air mixture spreading inside the premix burner. The inside diameter of the mixing pipe hereby can remain almost unaffected. In another embodiment, the catalyzer unit is provided on the inside, downstream at the exit of the mixing pipe in such a way that peripheral partial flows of the fuel/air mixture in a forcibly guided manner pass through the catalyzer material, especially since the catalyzer material narrows the flow cross-section within the mixing pipe at the latter's exit towards the combustion chamber.

Also conceivable are constructions in which the catalyzer unit is constructed between the mixing pipe and combustion chamber in the manner, for example, of a pin diaphragm.

BRIEF DESCRIPTION OF INVENTION

Figure 2:
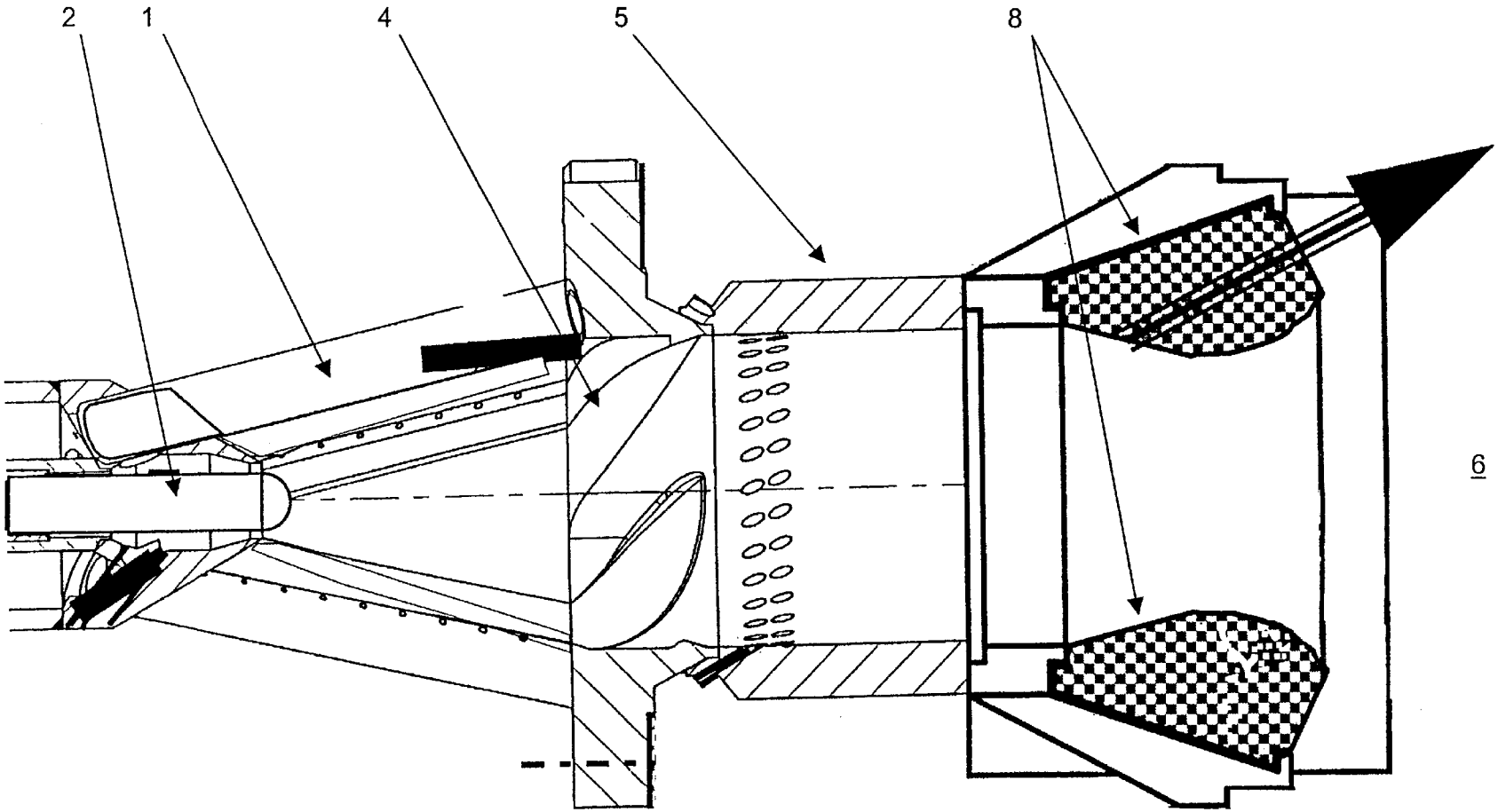

The invention is described below as an example, using exemplary embodiments in reference to the drawings without limiting the general idea of the invention. Hereby:

FIG. 1 shows a premix burner arrangement with a catalyzer unit positioned outside of the mixing pipe; and, FIG. 2 shows a premix burner arrangement with a catalyzer unit positioned inside of the mixing pipe.

WAYS OF EXECUTING THE INVENTION, COMMERCIAL USABILITY

FIG. 1 shows a longitudinal section through a premix burner arrangement with a mixing section, which comprises in an actually known manner the following components. In the center of a conically constructed, swirl-generating premix burner, an injection nozzle 2 is provided, said injection nozzle atomizing preferably liquid fuel axially to the premix burner arrangement. Via air inlet slits 3 positioned longitudinally to the conically constructed partial shells 1 of the premix burner, a fuel/air mixture is produced inside the premix burner arrangement, said fuel/air mixture spreading downstream, i.e., in the drawing plane of FIG. 1, from left to right. A swirl generator 4 downstream from the conical premix burner impresses a critical swirl value onto the fuel/air mixture, said swirl value permitting a stable flame front 7 to form inside the combustion chamber 6. Downstream from the swirl generator, a mixing pipe 5 in which the fuel/air mixture can be completely mixed before entering the combustion chamber 6 is provided.

Around the area 51 of the mixing pipe 5, a catalyst unit 8 is provided, which completely surrounds the mixing pipe area 51 in a circular manner. The catalyzer unit 8 is preceded in flow direction by branch-off channel 9 that also extends in a completely circular manner inside the mixing pipe 5, through which branch-off channel the peripheral portion of the fuel/air mixture inside the mixing pipe 5 is removed in the direction towards the catalyzer unit 8. The main portion of the fuel/air mixture passes unhindered axially through the mixing pipe 5 and is ignited inside the combustion chamber 6. The forcibly removed peripheral fuel/air mixture flows passing through the catalyzer unit 8 are converted by the latter at least in part thermally and/or chemically by catalytic action, and after exiting from the catalyzer unit 8 immediately enter the combustion chamber 6, where they meet the peripheral areas of the flame front 7 and are able to stabilize it.

The inside contour of the mixing pipe 5 is preferably constructed so as to narrow at the entrance areas of the outlet channels 9, so that the branching off of the peripheral fuel/air mixture parts takes place forcibly.

Another alternative embodiment is shown in FIG. 2. In this case also, the embodiment shows the basic arrangement of an actually known premix burner arrangement with central fuel injection 2, a conically constructed premix burner, a swirl generator 4 positioned downstream from the premix burner, and a mixing pipe 5 provided for completing the mixing of the fuel/air mixture. Not shown in detail is the combustion chamber 6 that follows the mixing pipe 5.

In contrast to the previously described embodiment, a catalyzer unit 8 is provided at the donstream end of the mixing pipe 5 in such a way that catalyzer material projects into the peripheral edge areas inside the mixing pipe 5 and reduces the flow cross-section through the mixing pipe 5. The catalyzer unit 8 is constructed of a porous material coated with catalyzer unit so hat peripheral flow portions of the fuel/air mixture spreading inside the premix burner unit forcibly flow through the catalyzer unit 8, in which they are at least in part converted calytically. The catalytic conversion takes place either thermally and/or chemically and, in addition to a decisive reduction of NOx emission values, also contributes to the stabilization of the flame front forming inside the combustion chamber.

LIST OF REFERENCE NUMERALS

1 Conically constructed partial shells of the premix burner
2 Injection nozzle
3 Air slits
4 Swirl generator
5 Mixing pipe
51 Mixing pipe area
6 Combustion chamber
7 Flame front
8 Catalyzer unit
9 Branch-off channel

What is claimed is:

1. A premix burner arrangement with catalytic combustion for supplying a completely non-ignited fuel/air mixture to a combustion chamber of a gas turbine, said premix burner arrangement comprising: a premix burner, said premix burner having a housing and at least one fuel addition unit as well as a plurality of inlet air openings arranged in such a way that at least one of gaseous and liquid fuel can be mixed with combustion inlet air inside the premix burner and form the fuel/air mixture, which exits from the premix burner downstream in the direction towards the combustion chamber positioned after the premix burner arrangement and which can be ignited inside the combustion chamber; and a catalyzer unit with a core fuel/air bypass mixing pipe positioned upstream of the combustion chamber such that at least part of the fuel/air mixture is introduced into and passes through the catalyzer unit to be at least partially catalyzed before the at least partially catalyzed fuel/air mixture flows, together with the remaining portion of the fuel/air mixture into the combustion chamber.

2. The premix burner arrangement according to claim 1, wherein:

the catalyzer unit is integrated into the premix burner at the downstream end of the premix burner or positioned directly adjoining the downstream end of the premix burner.

3. The premix burner arrangement according to claim 1 or 2, wherein a branch region is provided for directing a portion of the fuel/air mixture produced in the premix burner into the catalyzer unit, the branch region including at least one flow channel that is open at an upstream end and peripherally borders the fuel/air mixture spreading inside the premix burner, with the at least one flow channel directing a portion of the fuel/air mixture to the catalyzer unit.

4. The premix burner arrangement according to claim 3, wherein:

the at least one flow channel that is open at an upstream end, at least partially surrounds in a circular manner the fuel/air mixture spreading inside the premix burner.

5. The premix burner arrangement according to claim 4, wherein a unit that narrows the flow cross-section of the fuel/air mixture is provided so as to adjoin the housing of the premix burner at the downstream end of the premix burner, and the at least one flow channel and the catalyzer unit are provided in the unit.

6. The premix burner arrangement according to claim 1 or 2, wherein the catalyzer unit has a geometry that narrows the flow cross-section inside the premix burner housing, said catalyzer unit being integrated at the end of the premix burner housing or provided downstream of the premix burner housing such that the fuel/air mixture flows at least in part through the catalyzer unit, and said catalyzer unit contains catalyzer material.

7. The premix burner arrangement according to claim 6, wherein the catalyzer unit comprises a porous material, the surface of the porous material being coated with a catalyzer layer.

8. The premix burner arrangement according to claim 7, wherein the catalyzer unit surrounds the fuel/air mixture in a circular manner.

9. A method for operating a premix burner arrangement with catalytic combustion wherein the premix burner arrangement includes a premix burner, at least one fuel addition unit and inlet air openings arranged in such a way that at least one of gaseous and liquid fuel can be mixed with combustion inlet air inside the premix burner to form a completely non-ignited fuel/air mixture, which exits from the premix burner downstream in the direction towards a combustion chamber positioned after the premix burner arrangement and which can be ignited inside the combustion chamber, the method comprising: catalytically converting at least a portion of the fuel/air mixture before the fuel/air mixture enters the combustion chamber; and flowing the catalytically converted portion of the fuel/air mixture with the remaining, uncatalyzed portion of the fuel/air mixture, into the combustion chamber.

10. The method according to claim 9, wherein a circular peripheral portion of the fuel/air mixture exiting from the premix burner is branched off in a circular manner and fed to a catalyzer unit.

11. The method according to claim 9 or 10, wherein the catalytic conversion takes place by way of at least one of thermal and chemical conversion.

12. The method according to claim 11, wherein the catalytic conversion takes place by way of a partial oxidation and generates at least in part the partial oxidation products CO and $H_2$.

13. The method as claimed in claim 12, wherein the catalytic conversation takes place upstream of and near a flame front forming inside the combustion chamber.

* * * * *